US005301953A

United States Patent [19]

Levin

[11] Patent Number: 5,301,953

[45] Date of Patent: Apr. 12, 1994

[54] CONSTRUCTION BOARD GAME WITH CHANCE DEVICE

[76] Inventor: John M. Levin, 412 Fairview Rd., Narberth, Pa. 19072

[21] Appl. No.: 891,389

[22] Filed: May 29, 1992

[51] Int. Cl.[5] ..... A63F 3/00

[52] U.S. Cl. ..... 273/276; 273/157 R

[58] Field of Search ..... 273/153 P, 243, 276, 273/160, 157 R; 434/211

[56] References Cited

U.S. PATENT DOCUMENTS 4,133,538 1/1979 Ambrose ..... 273/276

4,417,732 11/1983 Guill ..... 273/276

OTHER PUBLICATIONS

"Jiggered", Readers' Games Reviewed by John Humphries, *Games and Puzzles*, No. 45, 1976.

*Primary Examiner*—Vincent Millin

*Assistant Examiner*—William M. Pierce

*Attorney, Agent, or Firm*—Caesar, Rivise, Bernstein, Cohen & Pokotilow, Ltd.

[57] ABSTRACT

A board game includes a board having a playing area to be filled by a plurality of playing pieces. Playing pieces of different geometric configurations are provided, with each geometric configuration being formed of a whole number multiple of a basic geometric shape. At least one indicating means is provided to identify each of the different geometric configurations. The indicating means is actuatable to randomly identify at least one geometric configuration of a playing piece to be placed on the playing area and/or removed from an opponent's playing area, with the geometric configuration being identified as a whole number multiple of the basic geometric shape. A number of embodiments of the above-described board game are part of the present invention as well as methods of playing the board games.

46 Claims, 7 Drawing Sheets

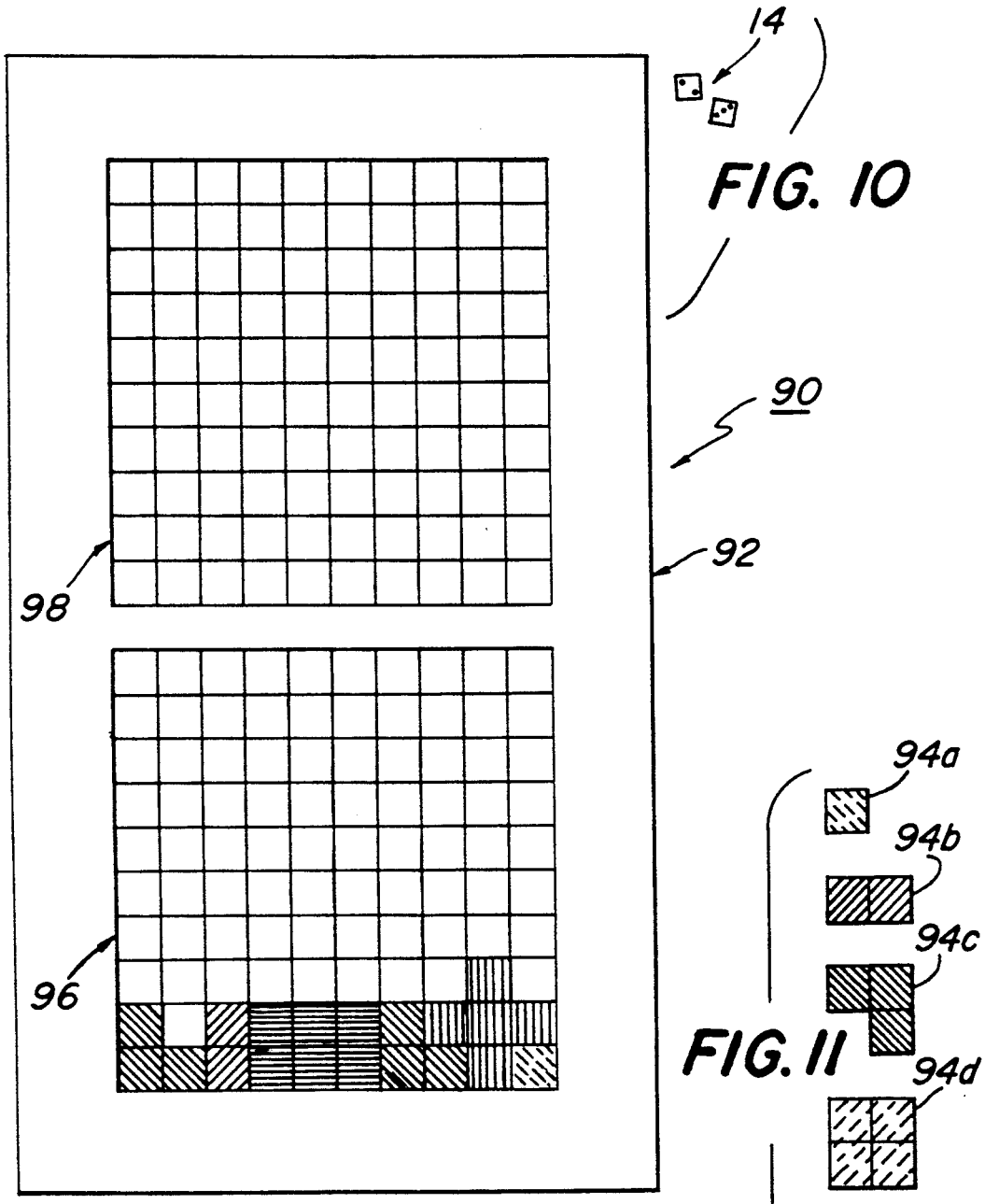
FIG. 10
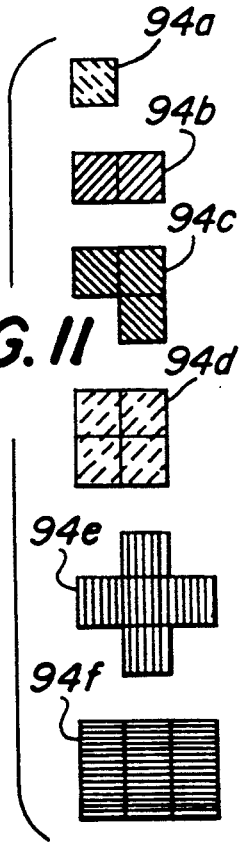
FIG. 11
FIG. 12
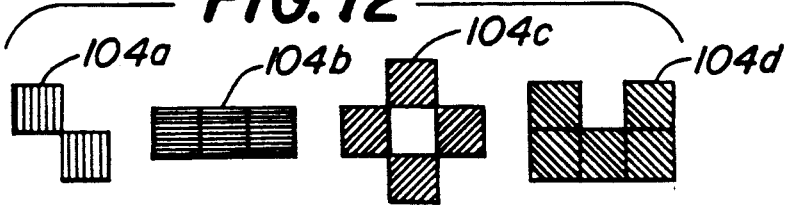

CONSTRUCTION BOARD GAME WITH CHANCE DEVICE

This invention relates generally to board games, and more specifically to board games employing multiple playing pieces to fill playing areas on a board and to methods of playing such games.

BACKGROUND ART

Computer controlled games have become quite popular in recent years. NINTENDO presently offers a wide variety of games playable on its stationary and hand-held units; one of the more popular games being a puzzle game emanating from the Soviet Union, and identified as TETRIS. In the TETRIS game seven different shaped blocks, each including four square units in the design, fall or move down a game field, one after the other. The object of the game is to keep the blocks from piling up to the top of the game field. To do this a player must control the movement of the blocks to the left and right, and rotate them as they fall. When a horizontal line is completely filled in, that line disappears from the board, and points are given to the player. If the blocks pile up to the top of the game field, the game ends.

In U.S. Pat. No. 4,527,800, issued to Samansky, a foldable board game is disclosed, wherein individual segments of the board are foldable to provide a box for a plurality of tetrahedral playing pieces. In this game there are three groups each of five playing pieces. The playing pieces in each group are the same color, but the color of the playing pieces in each group differs from the color of the playing pieces in every other group. In accordance with an illustrative game the various playing pieces are moved along the board in a desired manner to capture the playing pieces of an opponent.

U.S. Pat. No. 4,133,538, issued to Ambrose, discloses a pyramid building game employing individual game boards for each of the players, a plurality of playing pieces having geometric configurations and a die 20. The object of the game is to assemble the various playing pieces to form a completed pyramid, and the die 20 indicates the number of building blocks which each player can assemble during his or her turn.

There are a variety of other games employing a game board with pieces adapted to be moved or positioned thereon. Representative games of this type are disclosed in the following United States patents:

| | |
|---|---|
| 1,165,688 (Maris) | 2,450,829 (Hayes) |
| 1,315,483 (Edwards) | 2,703,713 (Moyer) |
| 2,307,609 (Stenberg) | 3,887,190 (Ameri) |
| 2,313,303 (Szatrow) | 3,929,337 (Hayes) |
| 2,342,899 (Sands, Jr.) | 4,213,615 (Price) |
| 2,400,644 (Hoffman) | 4,415,161 (Westell) |
| 2,414,165 (Paschal) | 4,527,800 (Samansky) |

Other games, which do not necessarily employ a board, but which do involve the manipulation of a plurality of geometrically shaped pieces in the playing of the game, are also known in the prior art. U.S. Pat. Nos. 282,990 and 3,547,444 are representative of these latter games.

While there are a number of desirable and entertaining games employing a board and multiple playing pieces, and also employing playing pieces of different geometric shapes, there always is a need for new, different, interesting and challenging games. It is to such new board games that the present invention is related.

OBJECTS OF THE INVENTION

It is a general object of this invention to provide board games which are entertaining and exciting to play.

It is a further object of this invention to provide board games wherein playing pieces are randomly identified, for placement and/or removal from a board to provide a high degree of entertainment.

It is a further object of this invention to provide board games which provide a learning experience for the players.

It is a more specific object of this invention to provide board games wherein an understanding of different geometric shapes is fostered.

It is a still another object of this invention to provide board games which bring out the competitive instincts of the players.

SUMMARY OF THE INVENTION

The above and other objects of this invention are achieved in board games including a playing board, a plurality of playing pieces, and at least one indicating means for randomly identifying one or more playing pieces. The board has a playing area to be filled by a plurality of playing pieces. The playing pieces are of a number of different geometric configurations, and each geometric configuration is a whole number multiple of a basic geometric shape. At least some of the plurality of playing pieces provided with the game are receivable on the playing surface for filling the playing area. At least one indicating means includes indicia for identifying each different geometric configuration, and the indicating means is actuatable to randomly identify at least one geometric configuration of one or more playing pieces, to thereby identify a playing piece(s) which is (are) to be placed and/or removed from a playing area. The geometric configuration is identified by a number, constituting a whole number multiple of the basic geometric shape from which the various configurations of the playing pieces is created or formed.

In accordance with a preferred embodiment of this invention the indicating means includes either one or two die of conventional design, each having indicia representative of the numerals 1–6 on each of the six faces thereof. Moreover, the geometric configurations of the various playing pieces are multiples of at least 1–6 of a basic geometric shape.

In accordance with a preferred board game of this invention at least one geometric configuration is a multiple of 12 of the basic geometric shape.

In a preferred embodiment of this invention multiple playing areas are provided; one for each player.

BRIEF DESCRIPTION OF THE DRAWINGS

Other objects and many of the attendant advantages of this invention will be readily appreciated as the same becomes better understood by reference to the following detailed description when considered in connection with the accompanying drawings wherein:

FIG. 10 is a plan view of still another embodiment of a board game in accordance with this invention;

FIG. 11 is a plan view of playing pieces utilized in the board game of FIG. 10;

FIG. 12 is a plan view of additional playing pieces which can be used in the board game of FIG. 10;

DESCRIPTION OF THE PREFERRED EMBODIMENTS OF THE INVENTION

Figure 1:
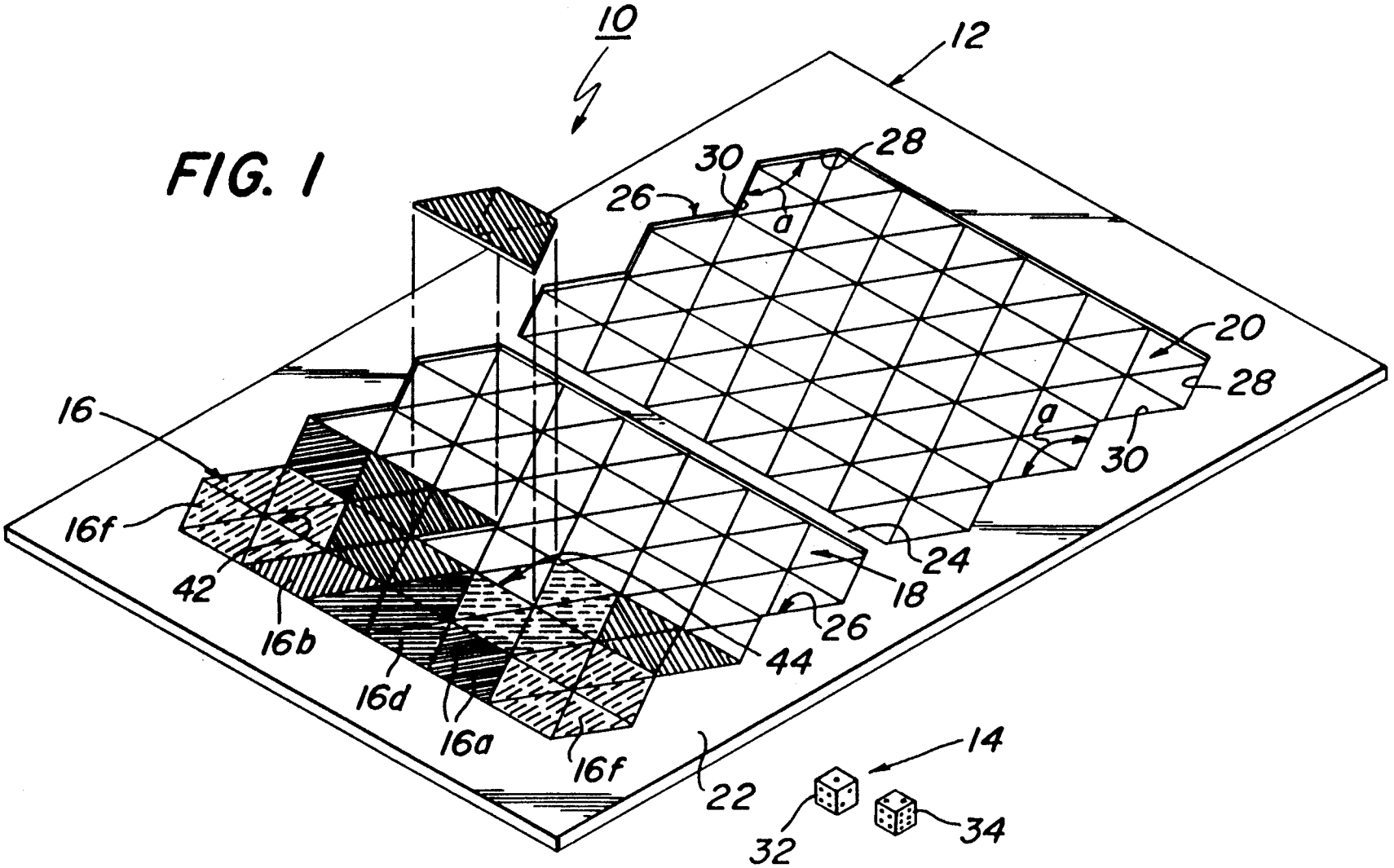
FIG. 1 is an isometric view of a board game in accordance with one embodiment of this invention.

Referring now in greater detail to the various FIGURES of the drawings wherein like reference characters refer to like parts, a board game embodying the present invention is generally shown at 10 in FIG. 1. The board game 10 basically comprises a playing board 12, a pair of dice 14 and a plurality of playing pieces 16.

Still referring to FIG. 1, the board 10 includes a pair of recessed playing areas 18 and 20, defined by a peripheral boarder 22 and a central dividing wall 24. The boarder defines zig-zag sidewalls 26 of each of the playing areas 18 and 20, and adjacent surfaces 28 and 30 of each zig-zag sidewall are at an included angle $\alpha$, of approximately 120°, to each other.

The dice 10 are of a conventional form, including two die 32 and 34, each having six sides containing dots representing the numerals one through six, respectively. As will be discussed in greater detail hereinafter, the board game 10 of this invention can be played with only a single die, if desired.

Figure 2:
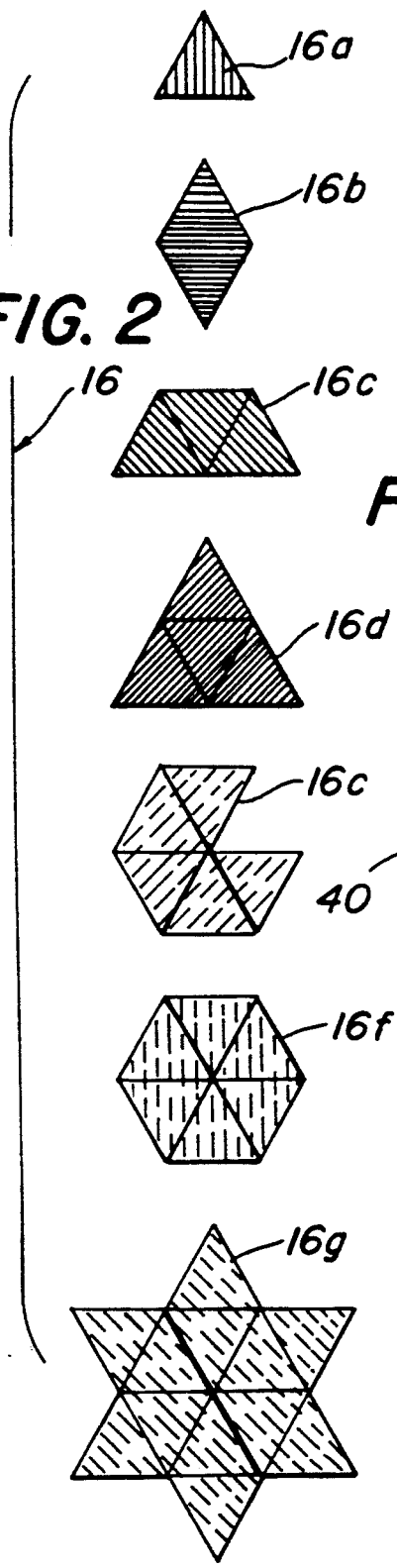
FIG. 2 is a plan view of playing pieces for the board game illustrated in FIG. 1.

Referring specifically to FIG. 2, the seven different configurations of playing pieces 16*a* through 16*g* utilized in the board game 10 are illustrated. It should be understood that there are a plurality of playing pieces having each configuration. In a preferred form of the invention there are 30 playing pieces each of 16*a* and 16*b*; 20 playing pieces each of 16*c* and 16*d*; 15 playing pieces each of 16*e* and 16*f*, and 6 playing pieces 16*g*. Of course, the number of playing pieces can be varied, as desired, provided that there is an adequate number of each piece to permit the game to be played.

Each of the different configurations 16*a*–16*g* employs an equilateral triangle as the basic geometric shape or unit thereof. Stating this another way, the configuration of each of the playing pieces 16*a* through 16*g* is a whole number multiple of the basic equilateral triangular shape or unit.

Referring specifically to FIG. 2, the playing piece 16*a* is a single equilateral triangular unit (i.e., multiple of "1"). The playing piece 16*b* is made up of two of the triangular units, to define a rhombus (i.e., multiple of "2"). The playing piece 16*c* is made up of three equilateral triangular units, to form a trapezoid (i.e., multiple of "3"). The playing piece 16*d* is made up of four of the basic equilateral triangular units, and also is in the configuration of a triangle (i.e., multiple of "4"). The playing piece 16*e* is made up of five of the basic equilateral triangular units, and is in the general shape of a hexagon, with one of triangular units omitted (i.e., multiple of "5"). The playing piece 16*f* is made up of six of the basic equilateral triangular units, arranged in the configuration of a hexagon (i.e., multiple of "6"), and playing piece 16*g* is made of twelve of the equilateral triangular units and is in the configuration of a star (i.e., multiple of "12").

It should be apparent that, in accordance with the preferred embodiment of the invention 10, the playing pieces are of varying geometric configurations, based upon whole number multiples of 1–6 and 12 of a basic geographic shape or unit.

Figure 3:
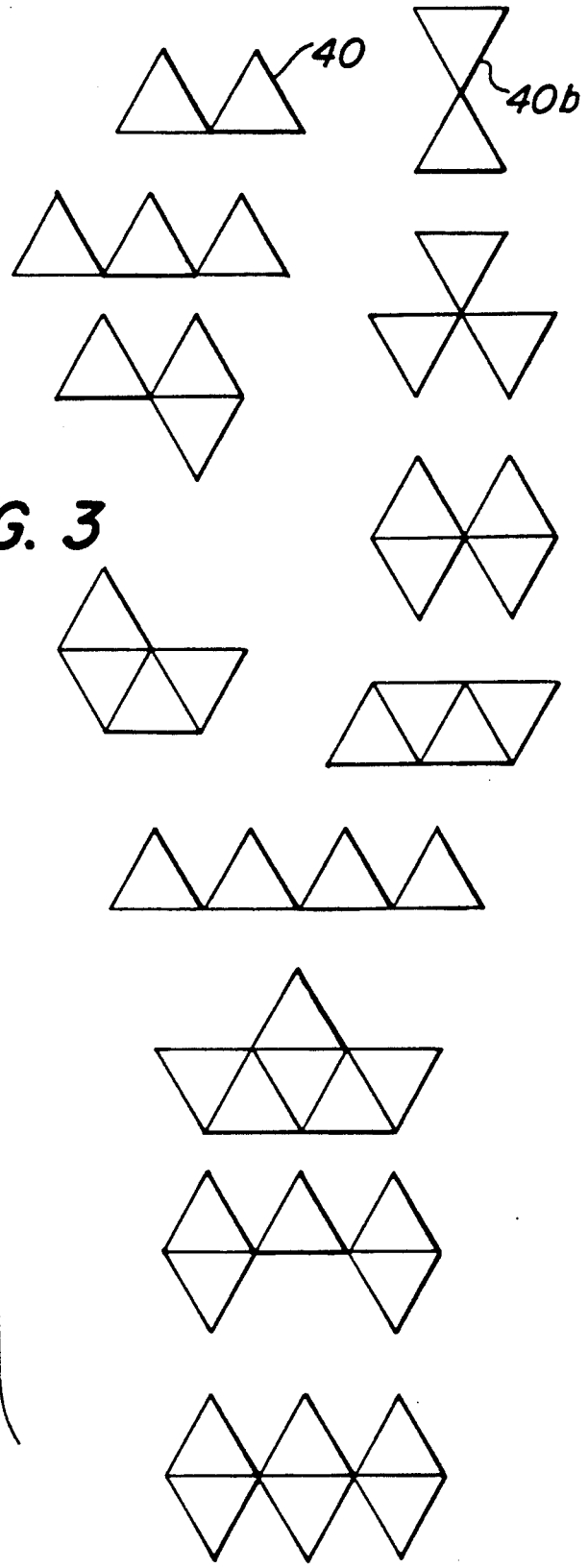
FIG. 3 is a plan view of additional configurations of playing pieces for use in the board game of FIG. 1.

Referring to FIG. 3, a variety of other configurations of playing pieces 40 are illustrated for use in the board game 10. Again, the basic geometric shape or unit is in the form of an equilateral triangle, but the various configurations, based upon whole number multiples of this basic unit, are interconnected in a variety of ways which differ from the arrangements of playing pieces 16 illustrated in FIG. 2.

It should be understood that when the playing pieces 40 are utilized, it also will include playing pieces of the single triangular unit illustrated at 16*a* in FIG. 2. It also should be noted that, in the illustrated embodiment, the playing pieces 40 do not include any configurations which are a multiple of "12" of the basic equilateral triangular unit. If desired, both playing pieces 16 and 40 can be employed as part of the game 10.

Referring to FIG. 1 it should be noted that each of the playing areas 18 and 20 is defined, in part, by a series of continuous, intersecting lines defining contiguous triangular units. Each triangular unit is the same as the basic triangular shape from which the configuration of the various playing pieces 16 and 40 are formed. This is a very desirable (although not critical) feature of the invention, since it illustrates to the players the geometric shape which makes up the various units, thereby fortifying an appreciation of geometric shapes and configurations for the players. Moreover, to further fortify an appreciation of geometric shapes, each of the playing pieces 16*b*–16*g* and 40 include indicia, in the form of lines, identifying the basic triangular units which make up each of said playing pieces.

Although the rules for playing the board game 10 can be varied in a number of ways, the basic object of the game is to be the first player to completely fill his or her playing area with playing pieces.

In an exemplary method of practicing the invention the dice 14 are first thrown by each player, and the player receiving the highest score goes first. Thereafter, the players take turns in throwing the dice, and each player, during his or her turn, either places pieces in his or her own playing area, or removes playing pieces from the playing area of his or her opponent.

In an exemplary method of playing the game each player, during his or her turn, throws the dice 14, and the number shown on each of the die 32 and 34 represents a specific configuration of playing piece 16. Specifically, each of the numbers 1–6 identifies the whole number multiple of the basic triangular unit, to thereby identify the configuration of the playing piece(s) 16 represented by that number (e.g., the number 1 represents the basic triangular unit 16*a*, whereas the number 6 represents the hexagonal unit 16*f*).

Only in the case of throwing double sixes can the sum be added to 12, thereby permitting the selection of the piece 16g having the star configuration. Moreover, the rules can provide for giving a player an extra roll after rolling a double six. When a player rolls a "12" (two "6's") he or she may also have the option of selecting two hexagonally configured pieces 16g, if he or she so desires, whether or not there is an open space for the star in that player's playing area.

In accordance with the rules a player, after rolling the dice 14, is permitted either to place a playing piece 16 having the identified configuration in his or her own playing area, or alternatively, to remove such a piece from his or her opponent's playing area, with one exception. That is, when a complete horizontal line defined by edges of several adjacent equilateral triangular units is created, none of the playing pieces which are employed to create that complete horizontal line can be removed by an opponent. For example, referring to FIG. 1, it should be noted that a lower horizontal line 42 is formed by the lower three (3) triangular units of hexagonal pieces **16*f*, the two triangular units of the rhombus 16*b*, the three lower triangular units of the larger triangular unit 16*d*, and the two individual triangular units 16*a*. Thus, even prior to forming continuous line 44 at the next level (see FIG. 1), neither of the lower hexagonal pieces 16*f* could be removed by an opponent, since the lower three triangular units thereof form a part of the continuous line 42**.

In accordance with the rules a player may be given an extra turn each time he or she completes a horizontal line (e.g., line 42, 44). Alternatively, the player may be given an extra turn upon completion of a first horizontal line (e.g., 42); two extra turns upon completion of a second horizontal line (e.g., 44), three extra turns upon completion of horizontal lines, etc.

In accordance with one form of the rules a player may add to his or her playing area a playing piece having a configuration identified by one die 32 or 34, and may remove from an opponent's playing area a piece having the configuration identified by the other die. Alternatively, a player may remove two identified playing pieces from his opponent's playing area or add two identified playing pieces to his or her own area, subject however to the rule that an opponent's playing piece which is part of a continuous line across the board cannot be removed. Moreover, an as an alternative rule, a player is not required either to place or remove a playing piece from the player's or opponent's playing area, respectively, if he or she chooses not to do so.

In accordance with an additional form of the rules, when the playing area of one of the players is filled with playing pieces, such that only a single piece is needed to enable the player to completely fill his or her playing area, and thereby win the game, the playing piece he needs to complete the playing area must have its specific corresponding configuration rolled on one of the die, and, at this point in the game, the player also is not permitted to remove any of his opponent's playing pieces. This, obviously, gives an opponent a chance to rapidly fill his or her side of the board, while the player needing only a single piece to fill his or her playing area is attempting to roll a number corresponding exactly to the configuration of that single piece.

As in other games, a piece laid is a piece played. That is, once a player has put his or her piece in a desired location in his or her playing area, the player may not rearrange that piece.

As a further variation of the game only one of the dice 32 or 34 can be employed up until the time that a complete horizontal line is formed by a player. At that time, the player forming the complete horizontal line is permitted to use both dice 14.

The game can be scored in a number of ways. For example, each game may be counted as an individual win; i.e., each time a player completely fills his playing area, he is considered to be the winner of the game. Alternatively, each game can be counted as some predetermined number of points, e.g., 100 points, plus some multiple (e.g., ten times) the number of opened equilateral triangular areas on his opponent's side of the board, with the first player reaching a predetermined number of points (e.g., 1,000 points) being considered the winner of the game.

In an advanced version of the game playing pieces having more than one configuration identified with a single number of the die can be provided. For example, note playing piece **16*b* and 40*b***, both of which are multiples of "2" of the basic unilateral triangular unit, but are of different configurations. When a playing piece having more than one configuration can be selected for a specific number on the die, the choices become more difficult, requiring more expertise.

Figures 4, 5:
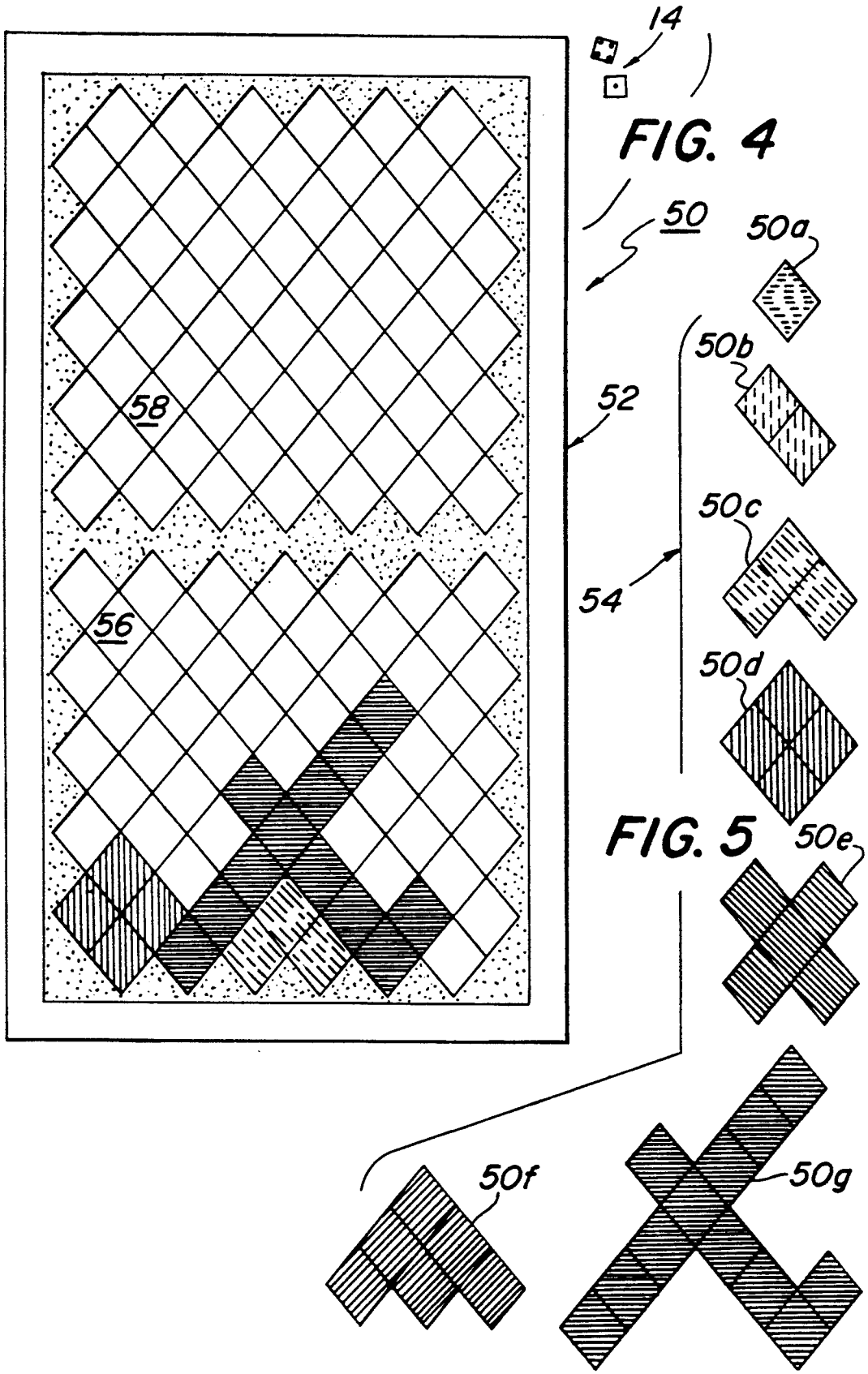
FIG. 4 is a plan view of an alternative embodiment of a board game in accordance with this invention.
FIG. 5 is a plan view of playing pieces for the board game illustrated in FIG. 4.

Referring to FIGS. 4 and 5, an alternative embodiment of a board game in accordance with this invention is shown at 50. This board game, like the board game 10, includes a playing board 52, a pair of dice 14 and a plurality of playing pieces 54.

The playing board 52 includes spaced-apart playing areas 56 and 58 for each of two players. As illustrated, visual markings are employed to identify and separate each of the playing areas 56 and 58. Specifically, stippling (or any alternative marking) is employed to outline the perimeter of each of the playing areas. Each of the playing areas is provided with angled lines intersecting each other to form an adjacent array of diamonds. It should be noted that the individual diamonds in the pattern constitute the basic geometric unit for each of the playing pieces 54.

It also should be understood that the playing areas 56 and 58 can be defined in other ways, such as by the use of a peripheral boarder and central dividing wall, similar to the peripheral boarder 22 and central dividing wall 24 in the board 12. Although the specific way in which the playing areas 56 and 58 are defined on the board can be varied in accordance with this invention, the use of indicia to define on the board the basic geometric shape upon which the configuration of the varying playing pieces is based, is considered to be a desirable (although not critical) feature of this invention.

Referring to FIG. 5, the playing piece **54*a* is in the configuration of a diamond, which is the basic geometric shape upon which the various configurations of all of the playing pieces 54 is based. Specifically, the playing pieces 54*b*, 54*c*, 54*d*, 54*e*, 54*f* and 54*g* are multiples 2–6 and 12, respectively, of the basic diamond shape shown at 54*a***.

It should be understood that the rules applicable to the board game 50 illustrated in FIGS. 4 and 5 are identical to the rules which apply to the board game 10, as discussed earlier herein.

Figure 6:
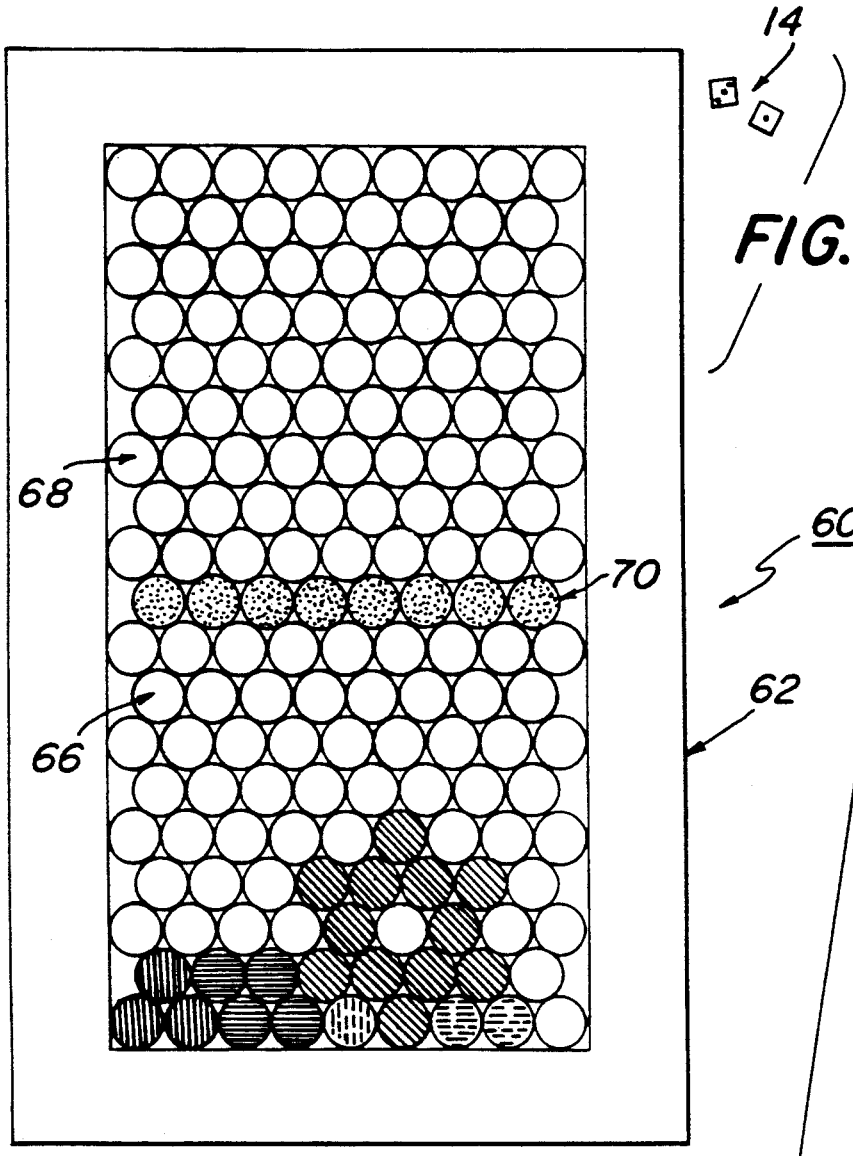
FIG. 6 is a plan view of a board game in accordance with another embodiment of this invention.
Figure 7:
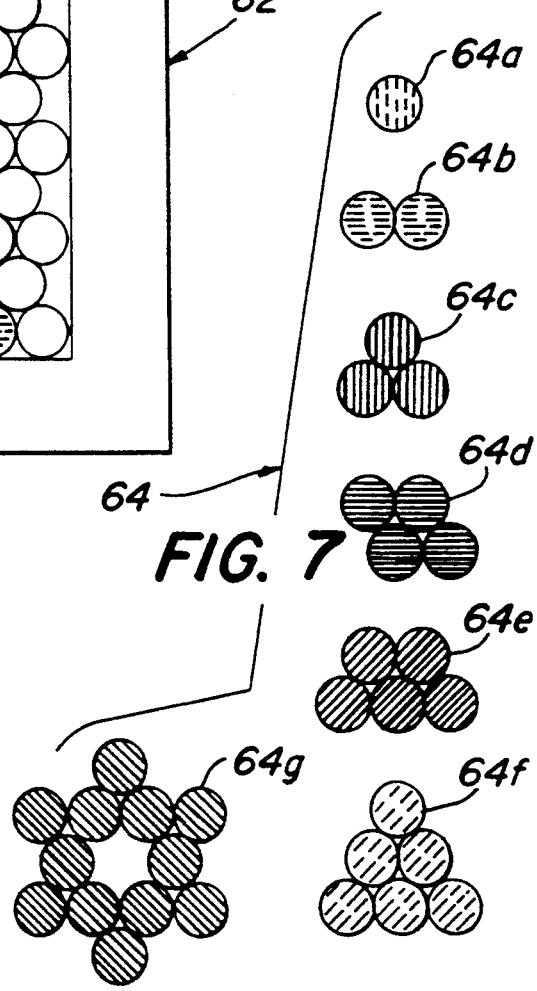
FIG. 7 is a plan view of playing pieces utilized in the board game of FIG. 6.

Referring to FIGS. 6 and 7 an alternative embodiment of a board game 60 in accordance with this invention is disclosed. This board game, like the earlier-described board games, includes a game board 62, a pair of dice 14 and a plurality of playing pieces 64.

The game board 62, like the earlier-described game boards 12 and 52, includes separate playing areas 66 and 68, for each of two players. In the illustrated embodiment visual indicia is provided to identify the two playing areas 66, 68 and also to separate the two playing areas from each other. Specifically, a horizontal row 70 of stippled, circular areas is provided to separate the playing area 66 from the playing area 68. Each of the playing areas is defined by a plurality of contiguous circular areas, in plan view, corresponding in general shape to the geographic shape of the basic unit 64*a* from which the multiple playing pieces 64 is derived.

As stated above the basic unit is generally circular, in plan view, and can either be in the form of a generally flat disk, or in the form of a sphere. When the various playing pieces 64 are generally flat, the surface of each playing area 66 and 68 likewise is preferably flat. However, when the individual playing pieces are made up of one or more spherical units, then the contiguous circular areas defining each of the playing areas 66 and 68 should be slightly recessed to accommodate the three-dimensional configuration of the various spherical units of each of the playing pieces.

As can be seen in FIG. 7, the playing piece 60*a* is formed as a general disk or sphere and constitutes the basic geometric unit for this version of the game. The configurations of playing pieces 60*b*, 60*c*, 60*d*, 60*e*, 60*f* and 60*g* are multiples of 2–6 and 12 of the basic geometric shape of the playing piece 60*a*.

It should be understood that the playing areas 66 and 68 can be defined, and separated from each other, in a number a ways. For example, the arrangement of providing a raised peripheral boarder and raised central dividing wall, similar to the peripheral boarder 22 and dividing wall 24 in the board game 10, can be employed in connection with the board game 60. Although the manner in which the playing areas 66 and 68 are defined and separated from each other does not constitute a limitation on the broadest aspects of the invention, it is considered highly desirable to include in each of the playing areas a visual representation of the basic geometric unit or shape from which the multiple playing pieces are derived.

It should be understood that the rules for playing the game 60 can be identical to the rules described in detail earlier, in connection with the board game 10.

Figure 8:
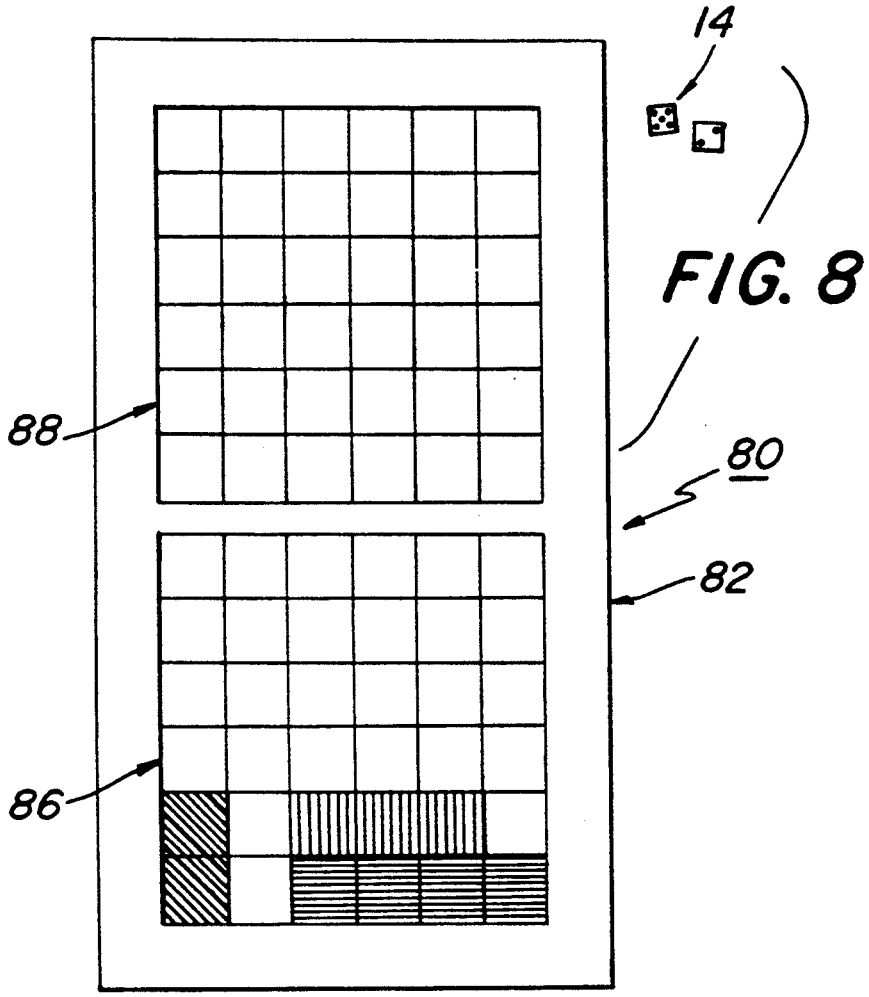
FIG. 8 is a plan view of another embodiment of a board game in accordance with this invention.
Figure 9:
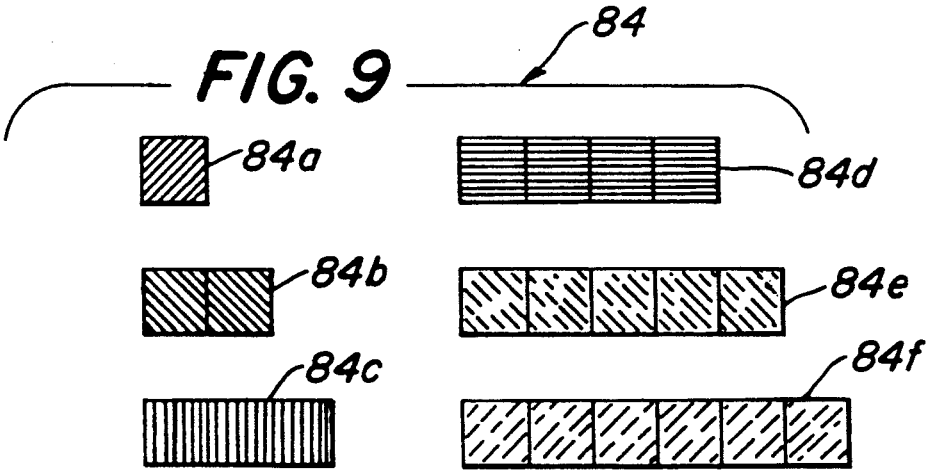
FIG. 9 is a plan view of playing pieces for the board game illustrated in FIG. 8.

Referring to FIGS. 8 and 9, a further embodiment of a board game in accordance with this invention is illustrated at 80. The board game 80 is a simpler version of the earlier-described games, and can be more easily played by youngsters in the two year old to six year old age group.

The board game 80 includes a playing board 82, a pair of dice 14 and a plurality of playing pieces 84. The playing board 82 is divided into two playing areas 86, 88, for each of two players, in a manner similar to the earlier-described embodiments of this invention. In the illustrated embodiment the upper surface of the board can be substantially planar, with visual indicia being employed to define and separate the two playing areas 86 and 88. As illustrated, each of the playing areas is identified by a plurality of generally vertical and transverse lines which cross each other, and thereby define the basic geometric unit from which the various playing pieces 84 are derived. Specifically, the various vertical and horizontal lines cross each other to form a plurality of contiguous "squares", which is the basic geometric unit for the playing pieces 84.

Referring to FIG. 9, the playing piece 84*a* is in the form of a square, and the configurations of playing pieces 84*b*, 84*c*, 84*d*, 84*e* and 84*f* are multiples of 2–6, respectively, of the basic square geometric unit or shape of the playing piece 84*a*.

It should be noted that, in this version of the game, each of the playing pieces is substantially linear, and all of the surfaces of the playing pieces are substantially perpendicular to each other. This geometric arrangement for the playing pieces makes it much easier for a player to position, in his or her respective playing area 86, 88, playing pieces identified by one or both of the dice 14.

It also should be noted that, in this version of the game, a playing piece constituting a multiple of 12 of the basic unit has not been included (although optionally it could be included in the form of a rectangle formed of a 2×6 array of the basic square unit). Thus, when a player rolls double sixes he can either place one or two of the playing pieces 6*f* in his playing area, assuming space permits, or remove one or two playing pieces 6*f* from his opponent's playing area, assuming that one of the exceptions precluding removal of an opponent's piece does not exist (e.g., such as when the player who rolled the dice only needs a single piece to fill his or her playing area).

It should be noted that each horizontal row in each playing area is made up of six of the basic geometric square units. Thus, it should be apparent that when a player rolls one or two sixes, the piece 6*f* identified by each die actually will fill one complete horizontal row. This functions to simplify the game, relative to the earlier-described games 10, 50 and 60, keeping in mind that pieces forming a horizontal line cannot be removed by an opposing player.

The board game 80 can be played in essentially the same manner as the board game 10, and, in fact, when a 12 unit piece is included, the rules for game 80 can be identical to the rules for game 10.

Referring to FIGS. 10–12, a further alternative embodiment of a board game is shown at 90. This game, like the earlier-described games, includes a playing board 92, a pair of dice 14 and a plurality of playing pieces 94 (FIG. 11) and/or 104 (FIG. 12).

The playing board 92 is most similar to the playing board 82, and includes separate playing areas 96 and 98 for each of two players. Each of the playing areas is identified by continuous vertical and transverse lines which intersect each other to define a plurality of contiguous squares. It should be noted that the square also is the basic geometric shape or unit from which the geometric configurations of the plurality of playing pieces 94 and/or 104 are derived. The individual squares identified with each of the playing areas 86, 88 are smaller than the individual squares in the game board 82. In fact, each horizontal row in each of the playing areas of the game board 92, in the illustrated embodiment, includes ten such "square" areas.

Referring to FIG. 11, playing piece 94 is configured in the basic geometric shape of a square. The configurations of the remaining playing pieces 94*b*, 94*c*, 94*d*, 94*e* and 94*f* are multiples 2–6 of the basic unit of the playing piece 94*a*.

Referring to FIG. 12, the configurations of the playing pieces 104*a*, 104*b*, 104*c* and 104*d* are multiples of 2–5, respectively of the basic unit of playing piece 94*a*.

As can be seen from reviewing FIGS. 11 and 12, the various playing pieces 94 and 104 have a number of different shapes, thereby making the game more interesting (and also more complicated) than the simplified board game 80 illustrated in FIGS. 8 and 9.

It should be understood that the board game 90 can be played with the playing pieces 94, the playing pieces 104 (including playing piece 94*a* as an additional unit) or both sets of playing pieces 94 and 104. In this latter case there are a plurality of playing pieces having two different configurations for each of the numerals 2–6, on each of the die, thereby giving the player an option regarding the configuration of the piece which can be added to his/her playing area and/or removed from his/her opponent's playing area for the number identified on each die of the pair of dice 14. The selection of the desired configuration increases the complexity of the game, and therefore requires the exercise of greater strategy.

It also should be noted that in the board game 90 there is no playing piece constituting a multiple of 12 of the basic square unit. Accordingly, when a player rolls "box cars" (double sixes), he has the option of placing playing pieces 94*f* and/or 104*d* on his side of the board, and/or removing playing pieces 94*f* and/or 104*d* from his opponent's side of the board, in accordance with the rules, and subject to the exceptions described earlier in connection with the board game 10 and the board game 80.

Figure 13:
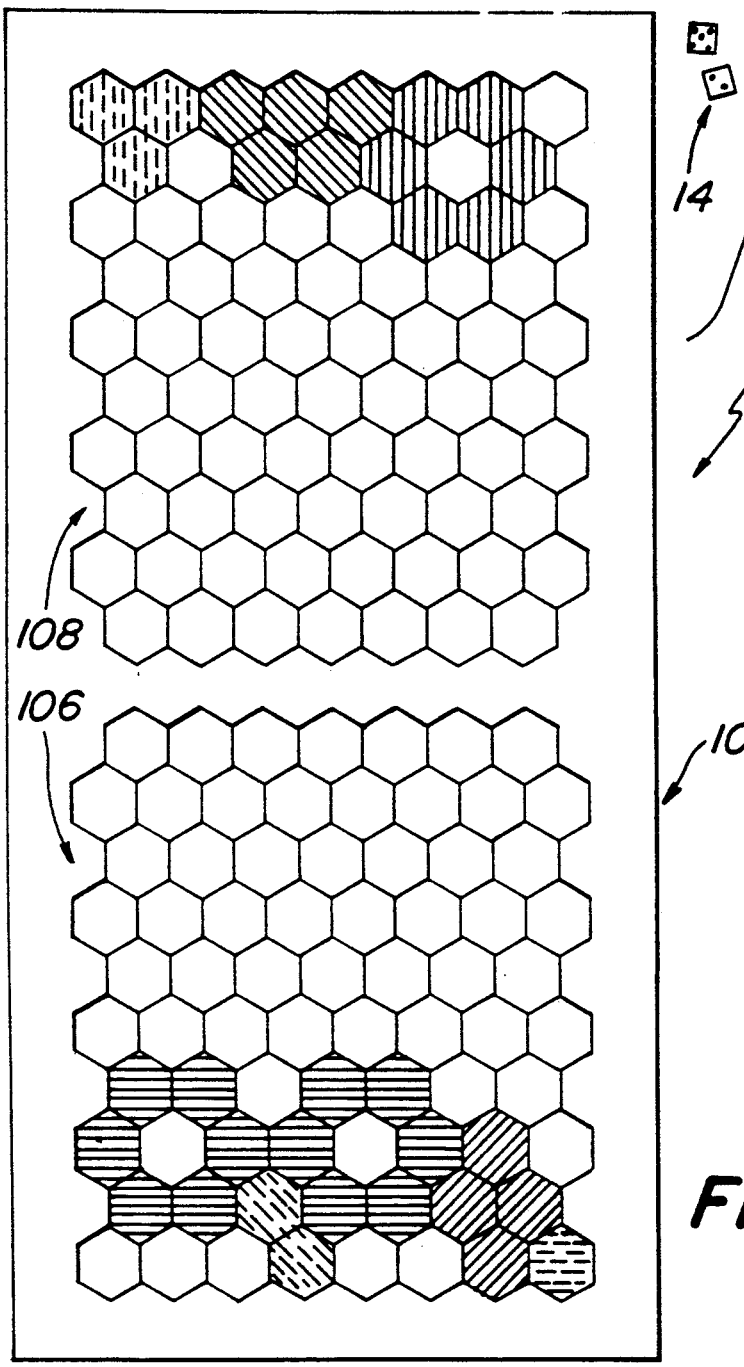
FIG. 13 is plan view of still another embodiment of a board game in accordance with this invention.
Figure 14:
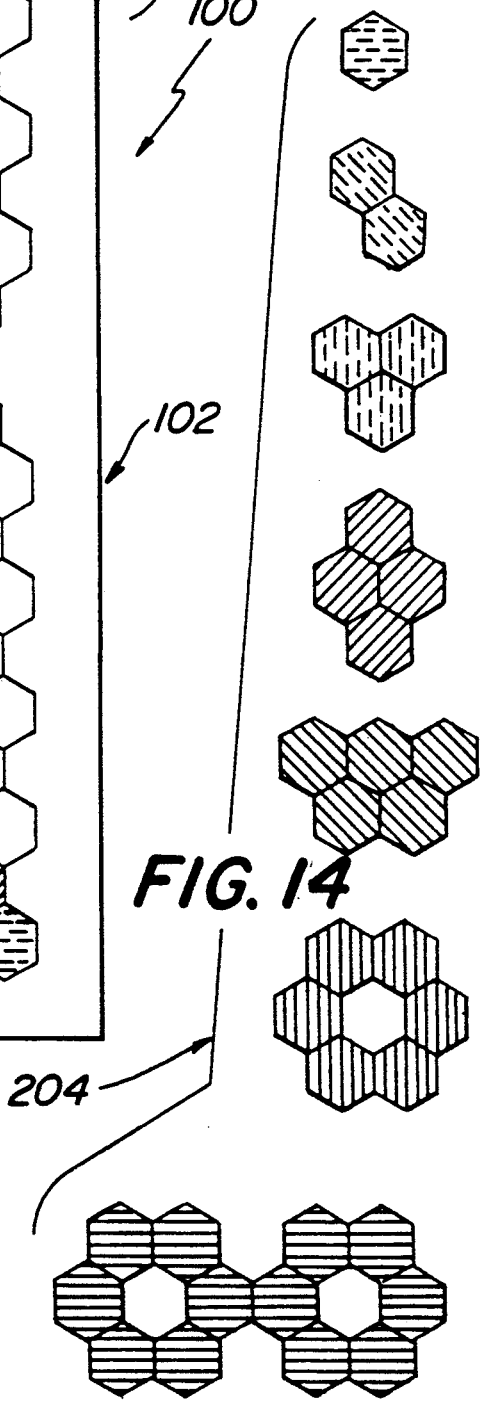
FIG. 14 is a plan view of playing pieces utilized in the board game of FIG. 13.

Referring to FIGS. 13–14, a further alternative embodiment of a board game is shown at 100. This game, like the earlier-described games, includes a playing board 102, a pair of dice 14 and a plurality of playing pieces 204.

The playing board 102 includes separate playing areas 106 and 108 for each of two players. Each of the playing areas is identified by continuous line segments defining a plurality of contiguous hexagons. It should be noted that the hexagon also is the basic geometric shape or unit from which the geometric configurations of the plurality of playing pieces 204 are derived.

It also should be understood that the playing areas 106 and 108 can be defined in other ways, such as by the use of a peripheral boarder and central dividing wall, similar to the peripheral boarder 22 and central dividing wall 24 in the board 12. Although the specific way in which the playing areas 106 and 108 are defined on the board can be varied in accordance with this invention, as explained earlier, the use of indicia to define on the board the basic geometric shape upon which the configuration of the varying playing pieces is based, is considered to be a desirable (although not critical) feature of this invention.

Referring to FIG. 14, playing piece 204*a* is configured in the basic geometric shape of a hexagon. The configurations of the remaining playing pieces 204*b*, 204*c*, 204*d*, 204*e*, 204*f* and 204*g* are multiples of 2–6 and 12, respectively, of the basic unit of the playing piece 204*a*.

It should be understood that the board game 100 can be played in accordance with the exact same rules described in connection with the board game 10.

Without further elaboration the foregoing will so illustrate my invention that others may, by applying current or future knowledge, adopt the same for use under various conditions of service.

What I claim as my invention is:

1. A board game to be played by more than one person, the winner of said game being the first person to fill an identified playing area on a board with a plurality of playing pieces, said board game comprising:

(a) a board having a playing surface with said identified playing area thereon, said playing area being sub-divided into a plurality of identical units, each unit being of a basic geometric shape;

(b) a plurality of playing pieces of different geometric configurations, each of said geometric configurations being formed of a whole number multiple of said basic geometric shape and at least some of said different configurations being formed of different whole number multiples of said basic geometric shape, at least some of said plurality of playing pieces being receivable on the playing surface for filling said playing area, each playing piece received on the playing surface overlying a number of the identical units equal to the whole number multiple of the basic geometric shape associated with the geometric configuration of said each playing piece; and (c) at least one die including a plurality of surfaces, each surface of each die including indicia for identifying a geometric configuration of a playing piece to be placed on the playing area, said indicia being a whole number multiple of said basic geometric shape to thereby identify a geometric configuration, the indicia on each surface of each die identifying a geometric configuration which is different from the geometric configuration identified by the indicia on every other surface of the same die.

2. The board game of claim 1, wherein the basic geometric shape is an equilateral triangle.

3. The board game of claim 1, wherein said basic geometric shape is a circle.

4. The board game of claim 1, wherein said basic geometric shape is a quadrilateral.

5. The board game of claim 1, wherein said basic geometric shape is a square.

6. The board game of claim 1, wherein said basic geometric shape is a diamond.

7. The board game of claim 1, wherein said basic geometric shape is a hexagon.

8. The board game of claim 1, wherein the identified playing area is defined between spaced apart end surfaces and spaced apart side surfaces, said side surfaces having a zig-zag configuration.

9. The board game of claim 8, wherein said zig-zag configuration includes adjacent surfaces disposed at an angle of approximately 120 degrees.

10. The board game of claim 9, wherein the basic geometric shape is an equilateral triangle, and wherein at least one geometric configuration of playing pieces includes adjacent surfaces disposed at an angle of approximately 120 degrees to each other for being receivable contiguous to the adjacent surfaces of the zig-zag configuration.

11. The board game of claim 9, wherein the basic geometric shape is an equilateral triangle, and wherein at least two of the geometric configurations of playing pieces, when placed contiguous to each other, includes adjacent surfaces disposed at an angle of approximately 120 degrees for being received contiguous to the adjacent surfaces of the zig-zag configuration.

12. The board game of claim 1, wherein the identified playing area is defined between spaced apart end surfaces and spaced apart side surfaces, at least said side surfaces having a non-planar, geometric configuration corresponding to the configuration of at least a portion of one of said plurality of playing pieces.

13. The board game of claim 12, wherein at least two of said plurality of playing pieces, when placed contiguous to each other, include adjacent surfaces disposed in a pattern for being received contiguous to the non-planar configuration of said side surfaces.

14. The board game of claim 1, wherein said board includes two playing areas for each of two identified players.

15. The board game of claim 14, wherein said board has opposed, spaced-apart ends, one of said identified playing areas includes an end surface adjacent one of said opposed spaced-apart ends and the other of said identified playing areas includes an end surface adjacent the other of said opposed spaced-apart ends.

16. The board game of claim 15 wherein each of said two identified playing areas is a recessed region of said board.

17. The board game of claim 15, wherein each of said two identified playing areas includes peripheral edges provided by an end border, a pair of side boarders and a central border, said central boarder separating said two identified playing areas from each other.

18. The board game of claim 17, wherein each of said two identified playing areas is a recessed region of said board.

19. The board game of claim 1, including a pair of dice, each die of said pair including a plurality of surfaces, each surface including indicia for identifying a geometric configuration of playing pieces, the indicia on each of said surfaces of each die identifying a geometric configuration which is different from the geometric configuration identified by the indicia on every other surface of the same die.

20. The board game of claim 19, wherein the indicia on the plurality of surfaces of one die of said pair of dice are identical to the indicia on the plurality of surfaces of the other die of said pair of dice.

21. The board game of claim 20, wherein each die includes 6 surfaces, each surface including indicia defining one of six different geometric configurations of playing pieces.

22. The board game of claim 21, including playing pieces having seven different geometric configurations, one of said configurations being defined by combined indicia on one surface of one die and one surface of the other die.

23. The board game of claim 21, wherein the indicia includes the numerals "1" through "6", respectively, on each of the six surfaces of each of the die, said numerals identifying the whole number multiple of the basic geometric shape.

24. The board game of claim 23, including playing pieces having seven different geometric configurations, one of said configurations being of said basic geometric shape, five other of said configurations being multiples of "2", "3", "4", "5" and "6", respectively, of said basic geometric shape, and another of said configurations being a multiple of "12" of said basic geometric shape.

25. The board game of claim 24, wherein said basic geometric shape is an equilateral triangle.

26. The board game of claim 24, wherein said basic geometric shape is a circle.

27. The board game of claim 24, wherein said basic geometric shape is a quadrilateral.

28. The board game of claim 24, wherein said basic geometric shape is a square.

29. The board game of claim 24, wherein said basic geometric shape is a diamond.

30. The board game of claim 24, wherein said basic geometric shape is a hexagon.

31. The board game of claim 1, wherein at least some playing pieces having different geometric configurations have the same whole number multiple of said basic geometric shape.

32. A board game to be played by more than one person, the winner of said game being the first person to fill an identified playing area on a board with a plurality of playing pieces, said board game comprising;

(a) a board having a playing surface with said identified playing area thereon, said playing area being sub-divided into a plurality of identical units, each unit being of a basic geometric shape;

(b) a plurality of playing pieces of different geometric configurations, each of said geometric configurations being a whole number multiple of said basic geometric shape and at least some of said different configurations being formed of different whole number multiples of said basic geometric shape, at least some of said plurality of playing pieces being receivable on the board for filling said playing area, each playing piece received on the playing surface overlying a number of the identical units equal to the whole number multiple of the basic geometric shape associated with the geometric configuration of said each playing piece; and (c) at least one indicating means including indicia for identifying each of said different geometric configurations and being actuatable for randomly identifying at least one geometric configuration of a playing piece to be placed on the playing area, said geometric configuration being identified as a whole number multiple of said basic geometric shape.

33. The board game of claim 32, wherein the selected geometric shape is an equilateral triangle.

34. The board game of claim 32, wherein said selected geometric shape is a circle.

35. The board game of claim 32, wherein said selected geometric shape is a quadrilateral.

36. The board game of claim 32, wherein said selected geometric shape is a square.

37. The board game of claim 32, wherein said selected geometric shape is a diamond.

38. The board game of claim 32, wherein said selected geometric shape is a hexagon.

39. The board game of claim 32, wherein at least some playing pieces having different configurations have the same whole number multiple of said basic geometric shape.

40. A method of playing a board game by at least two players, the object of which is to be the first player to completely fill a playing area on a board with a plurality of playing pieces, including the steps of:

(a) providing a board having a playing area for each player, each of said playing areas being adapted to be filled by a plurality of playing pieces;

(b) providing a plurality of playing pieces of different geometric configurations, each of said configurations being a whole number multiple of a basic geometric shape and at least some of said different configurations being formed of different whole number multiples of said basic geometric shape.

(c) providing at least one indicating means including indicia for identifying each of said different geometric configurations and being actuatable for randomly identifying at least one geometric configuration; the game being played by each player:

actuating said indicating means for randomly identifying one or more geometric configurations in the form of a specific whole number multiple of said basic geometric shape; and placing playing pieces having randomly identified geometric configurations on the player's playing area until said player's playing area is filled by playing pieces.

41. The method of claim 40, wherein each player, after actuating the indicating means, and at such time when he or she needs more than one playing piece to completely fill his or her playing area, having the option of removing from an opposing player's playing area a playing piece having an identified configuration and which does not include a basic geometric shaped unit thereof as part of a completely filled row of such units.

42. The method of claim 41, wherein each player, after actuating the indicating means, has the option of removing from an opposing player's playing area a playing piece having a configuration randomly identified by the indicating means, only when the player actuating the indicating means needs more than one playing piece to completely fill his or her playing area.

43. The method of claim 40, wherein said indicating means includes at least one die including six surfaces having the numerals "1" through "6", respectively, thereon, and further wherein the playing pieces have at least six different geometric configurations, one configuration being of said basic geometric shape and five other configurations being multiples of "2", "3", "4", "5" and "6" of said basic geometric shape; including the steps of actuating the indicating means by throwing said at least one die to randomly identify a geometric configuration as a whole number multiple of said basic geometric shape, and placing a playing piece having the identified configuration on the player's playing area, until a playing area is filled by one of said players.

44. The method of claim 43, wherein said indicating means includes a pair of dice, each die thereof including six surfaces and having the numerals "1" through "6", respectively, thereon, and further wherein the playing pieces have at least six different geometric configurations, one configuration being of said basic geometric shape and five other configurations being multiples of "2", "3", "4", "5" and "6" of said basic geometric shape; including the steps of actuating the indicating means by throwing said pair of dice to randomly identify, on each die, a geometric configuration as a whole number multiple of said basic geometric shape, and placing a playing piece having the configuration randomly identified by at least one die on the player's playing area, until a playing area is filled by one of said players.

45. The method of claim 44, wherein said playing pieces include seven different geometric configurations, one of said configurations being a multiple of "12" of said basic geometric shape; including the step of placing on a player's playing area a playing piece having a geometric configuration made up of a multiple of "12" of the basic geometric shape, when each of the die, after being thrown, identifies a "6".

46. The method of claim 40, including the step of providing at least some playing pieces having different geometric configurations with the same whole number multiple of said basic geometric shape.

* * * * *